United States Patent [19]

Staar

[11] 4,331,264

[45] May 25, 1982

[54] PACKAGE FOR ACCOMMODATING AND EJECTING SMALL AMOUNTS OF FLOWING MATERIAL

[75] Inventor: Marcel J. H. Staar, Brussels, Belgium

[73] Assignee: Panpack A.G., Vaduz, Liechtenstein

[21] Appl. No.: 156,625

[22] Filed: Jun. 5, 1980

[30] Foreign Application Priority Data

Jun. 8, 1979 [BE] Belgium ..... 876856

[51] Int. Cl.[3] ..... B65D 35/22

[52] U.S. Cl. ..... 222/94; 222/564

[58] Field of Search ..... 222/92, 1, 107, 94, 222/541, 215, 564, 491, 212; 229/3.5; 128/261

[56] References Cited

U.S. PATENT DOCUMENTS

| | | | |
|---|---|---|---|
| Re. 24,251 | 12/1956 | Kaplan et al. | 222/107 |
| 2,681,168 | 6/1954 | McMillion | 222/107 |
| 2,750,075 | 6/1956 | Land et al. | 222/94 |
| 2,916,886 | 12/1959 | Robbins | 62/4 |
| 3,637,132 | 1/1972 | Gray | 229/53 |
| 3,964,604 | 6/1976 | Prenntzell | 206/219 |

FOREIGN PATENT DOCUMENTS

| | | |
|---|---|---|
| 1783677 | 2/1959 | Fed. Rep. of Germany . |
| 1905452 | 11/1964 | Fed. Rep. of Germany . |
| 2058139 | 5/1972 | Fed. Rep. of Germany . |
| 2707841 | 8/1978 | Fed. Rep. of Germany . |

*Primary Examiner*—Stanley H. Tollberg

*Attorney, Agent, or Firm*—Leydig, Voit, Osann, Mayer and Holt, Ltd.

[57] ABSTRACT

A package for storing and method for ejecting small amounts of flowing material, especially liquids, viscous or pasty material, from the package which comprises foil sections which are joined together and form a compressible container for storing said material, an enclosed chamber separated from the container by a predetermined rupture site and having throttling means associated with the chamber for regulating the flow of material to a discharge opening when pressure is applied to compress the storage container and continued after site is ruptured.

11 Claims, 7 Drawing Figures

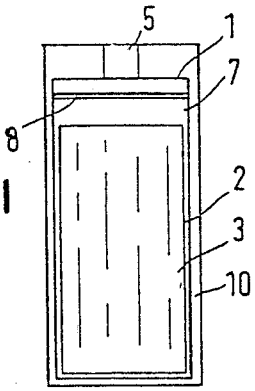
FIG. 1
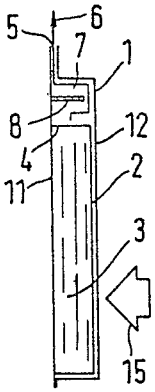
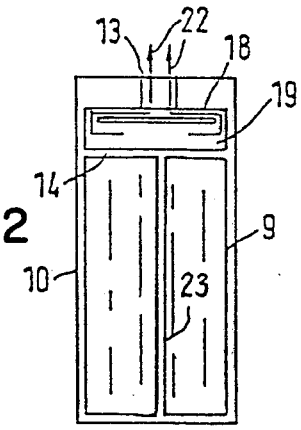
FIG. 2
FIG. 7
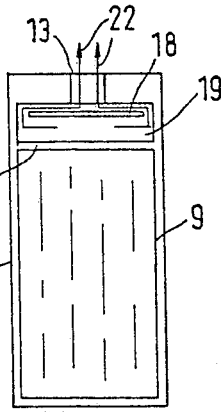
FIG. 3
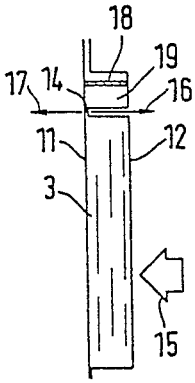
FIG. 4
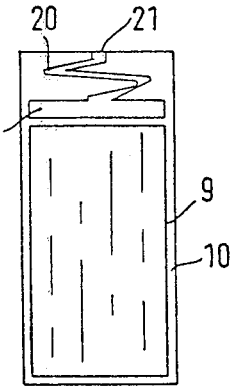
FIG. 5
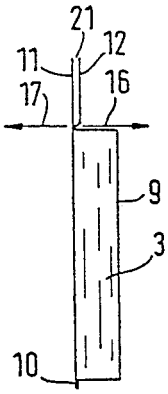
FIG. 6

PACKAGE FOR ACCOMMODATING AND EJECTING SMALL AMOUNTS OF FLOWING MATERIAL

This application is related to co-pending application Ser. No. 055,515, filed July 9, 1979 entitled "Package for Storing and Spraying Small Amounts of Liquids" now U.S. Pat. No. 4,275,840.

The present invention relates to packages for the accommodation and dispensing of small amounts of flowable, in particular liquid, viscous, pasty materials.

More particularly, the invention relates to a package formed of two foil sections joined with one another and providing a compressible container for the storage of the material and a chamber adjacent the compressible container, the chamber being separated from the container by a barrier which has a predetermined rupture site and communicating with an outlet opening for the material. The package of this invention is of the type that may be compressed by the user between his fingers to discharge the contents of the storage container.

In known packages of this general type there is the disadvantage that after the bursting or opening of the predetermined rupture site by application of a strong pressure to the compressible container the material passes directly to the outlet opening and is discharged. Thereby, material can be lost, and in the case of unfavorable alignment of the package even soil the clothing of the user. A further disadvantage lies in that in pressing the storage container to discharge material out of the package the emergence rate and the amount emerging are very strongly dependent on the finger pressure that the user applies to the container with the material situated in it. This is a particular problem, for example, if a strand of a pasty mixture component is to be applied to a standard (Mess-stab) for purposes of dosage, a liquid component is to be combined constantly with another component or sealing or coating material is to be applied in a constant film thickness to an underlayer.

Further, for the storing and dispensing of shoe polish it is a known practice to provide a sponge with the container, with interposition of a predetermined rupture site, and the shoe polish is dispensed through the pores of the sponge in dependence on the pressure applied to the compressible container. This arrangement has the disadvantage that a rather high pressure is required to press the shoe polish through the open pores of the sponge, residues always remaining within the sponge, which render difficult a repeated use of the package and preclude a complete using-up of the material.

Considering these and other problems, it is an object of the present invention to provide a package for the accommodation or storing and dispensing of small amounts of flowing material, in which a premature discharge of the material on application of increased pressure for the bursting or opening of the predetermined rupture site is avoided and in the dispensing of the material a constant rate of discharge, independent of pressure, of the material from the outlet opening is ensured.

More specifically, an object of this invention is to overcome the problem heretofore found in packages of this type, by providing means for throttling the discharge of the material to control its flow from the storage container when the barrier sealing the container is ruptured by pressure applied to the material in the container.

This invention achieves the advantage that the package can be opened without aids, such as a scissors, and solely by finger pressure and the contents will be discharged at a regulated rate.

The material is stored in the container and secured against the escape even of the smallest amounts. The chamber which is separated by the barrier and predetermined rupture site from the container storing the material, is provided with an outlet opening that is always open and has a predeterminable form and size. The outlet opening, therefore, can be formed for the extrusion of wide, thin films or of strands that have a rectangular, oval or round cross sections. Such material strands are suited for the apportioning of one or more components of a mixture of compound. The compressible container is opened in such a manner that a heavy pressure is applied to the container, so that the material bursts or opens the barrier at the predetermined rupture site. Independently of the emergence rate of the material from the container, the material is at first retained in the adjacent chamber by reason of a throttling action. Despite the application of a heavy pressure, no material escapes through the outlet opening. Only upon continued application of pressure to the compressible container is material discharged constantly through the outlet opening, this escape or constant dispensing likewise being controlled by the throttling means. Uneven pressing, therefore is accommodated by the throttling means provided in the device. The emerging material stream, therefore, is also largely independent of the amount of material still present in the compressible container.

Expediently the throttling means is constructed as a blocking wall arranged inside the chamber. The blocking wall can be secured to one of the foil sections. It can also be formed in one piece with one of the foil sections.

Another means of providing throttling effect may be provided by a flat channel that connects the chamber with the outlet opening. Expediently, the length of the channel is chosen dependent on the viscosity of the material, so that it is made certain that on application of the first increased pressure upon the compressible container for the bursting or opening of the predetermined rupture site the material in the channel is choked, but on subsequent pressing the emergence of the material from the channel is not hampered. The throttling channel can be made in serpentine form.

Another feature of the invention is that the chamber adjacent the predetermined rupture site is formed empty, so that it is likewise compressible and thereby makes possible the discharge of small doses of material that correspond exactly to the volume of the chamber.

Further, the invention relates to a process for dispensing small amounts of flowing material from a package by increasing the internal pressure within a compressible container for the storage of the material and with a chamber adjacent the compressible container, the chamber being separated from the container by a predetermined rupture site and being in communication with an outlet opening for the material, it being provided according to the invention that by increasing the internal pressure of the compressible container the predetermined rupture site is opened, the material inside the container released from pressure and is held by a throttling means inside the chamber and the material is thereby continuously dispensed by means of pressure further applied to the compressible container carrying the material to pass the throttling means or choke.

In the drawing there are represented examples of packages embodying the invention, which are explained in the following description.

FIG. 1 shows in plan view a package embodying the invention;

FIG. 2 is a longitudinal section of the package according to FIG. 1;

FIG. 3 shows in plan view another package embodying the invention;

FIG. 4 is a longitudinal section of the package according to FIG. 3;

FIG. 5 shows in plan view a third package embodying the invention;

FIG. 6 is a longitudinal section of the package according to FIG. 5; and

FIG. 7 shows in plan view a fourth package embodying the invention.

In all examples of packages embodying the invention, the package consists of two foil sections 11 and 12 which are joined in dthe zone of their surrounding edge 10 by gluing, welding, hot-sealing, pressing or the like with sealing effect. The foil section 11 can be separated from a flat web and consists preferably of a laminate of metal foil and thermoplastic material. The foil section 12 is deep-drawn and consists preferably of thermoplastic material such as translucent polyethylene.

In the example of the invention according to FIGS. 1 and 2 the foil sections 11 and 12 form an outer container 1, in which there is arranged an inner container 2 of smaller volume for the storage of flowable material 3. The inner container 2 is rectangular and expediently welded with the foil section 11. In the formed wall of the inner container 2 there is provided a predetermined rupture site 4. Through the volume difference of the outer container 1 and of the inner container 2 adjacent the predetermined rupture site 4 there is formed a chamber 7, which is provided with an outlet opening 5. Inside the chamber 7 there is provided a throttling means for the material, herein shown as a blocking wall 8, which in the example illustrated is fastened to the foil section 11. It can also be formed in one piece with the foil section 11. The blocking wall 8 has less height than the chamber 7 and can be also fastened to the side walls of the outer container 1.

When pressure is applied according to arrow 15 to the outer container 1 and thereby also to the inner container 2, the flowable material 3 bursts the predetermined rupture site 4 and flows into the chamber 7 being retained therein and throttled in its flow by the blocking wall 8. If pressure is continued according to arrow 15, then the material escapes on the path indicated by the arrow 6 at a constant flow rate and flow strength.

In the example of the invention according to FIGS. 3 and 4 the foil section 11 is again constructed flat, while the foil section 12 is deep-drawn, in order to form a container 9 and a chamber 19, which after the joining of the two foil sections 11 and 12 in the zone of the surrounding edge 10 and the transverse rupture site 14 are separated from one another by this barrier. The chamber 19 is provided with a flat-rectangular outlet opening 13. Inside the chamber 19 there is present as choke or throttling means a blocking wall 18 that is narrower than the space 19, but extends from the foil section 11 to the foil section 12 and can be joined with both. Through the dimensioning of the blocking wall 18 there result two flow paths, which are indicated by the arrows 22, as soon as a pressure according to arrow 15 is applied to the container 9 and the predetermined rupture site 14 is burst, whereby the two foil sections 11 and 12 which are joined along the transverse axis of the rupture site separate from one another as indicated by arrows 17 and 16. In the first application of pressure the blocking wall 18 at first retains the flowable material 3 in the chamber 19 until after continuation of the pressure application the material emerges from the package according to arrows 22 through the opening 13.

In the third example of the invention according to FIGS. 5 and 6, the predetermined rupture site is constructed in the same manner as that according to FIGS. 3 and 4. The chamber 19, however, is substantially flatter and has no blocking wall as such. Following upon the chamber 19 there follows as choke or throttling means a channel 20 winding in serpentine form, the length of which is chosen dependent on the viscosity of the material, so that upon pressure applied to the container for the bursting or opening of the rupture site 14 the material enters channel 20 and is choked, but on continued pressing the material emerges from the outlet opening. At the open end of the choke channel 20 there is the outlet opening 21. The opening of the pre-determined rupture site 14 and the dispensing of the material takes place in the same manner as in the earlier described examples of the invention.

The single inner container 2 shown in FIGS. 1 and 2 can be replaced by two containers that can be constructed for the storage of different fluids or materials. On the other hand, inside the container 9 of FIGS. 3–6 there can be provided a longitudinally or transversely running partition, as shown for example in FIG. 7 which includes a longitudinal partition 23, which likewise makes possible the storage of different liquids or other material.

By controlling the strength of bond between the two foil sections in the zone of the predetermined rupture site 14, especially in the example of the invention according to FIGS. 3 and 4, the barrier provided between the storage container and the throttling chamber can be made so that it ruptures to provide a flat relatively narrow channel between the storage container 9 and the chamber 19, so that when finger pressure is applied to the chamber 19 only the material that happens to be in this chamber is discharged. In this manner extremely small precisely apportioned amounts can be dispensed which correspond substantially to the volume of the chamber 19. In all examples of the invention, the strength of bond between the foil sections is controlled so that the site 14 ruptures at a predetermined finger pressure to release the contents, and as finger pressure is continued, to discharge the contents of the container.

I claim:

1. In a package for storing and ejecting small amounts of flowing material, especially liquids, viscous or pasty material, said package comprising foil sections which are joined together and form a sealed compressible container for storing said material, and a discharge opening adapted to eject said material, the improvement comprising a chamber between said compressible container and said discharge opening, separated from said container by a barrier including a predetermined rupture site and having throttling means associated with said chamber for regulating the flow of material being ejected from said container to said discharge opening when external pressure is applied to compress said compressible storage container and continued after said barrier is ruptured at said site by said external pressure.

2. The improvement according to claim 1 wherein said throttling means includes a blocking wall within said chamber.

3. The improvement according to claim 2 wherein said blocking wall is fixed to one of said foil sections.

4. The improvement according to claim 3 wherein said blocking wall is unitary with one of said foil sections.

5. The improvement according to claim 1 wherein said throttling means is provided by a flat channel connecting said chamber to said discharging opening.

6. The improvement according to claim 5 wherein said channel has a predetermined length for retaining the material within said channel which is dependent on the viscosity of the material when external pressure is applied to compress said compressible container and said barrier is ruptured at said site by said pressure;

7. The improvement according to claim 5 wherein said throttling channel is a serpentine channel.

8. The improvements according to any one of claims 1 to 7 wherein a further compressible container for storing a liquid or other material is arranged adjacent to said compressible container and said chamber and is separated from said chamber by a barrier including a predetermined rupture site rupturable by external pressure.

9. The improvements according to claim 8 wherein both compressible containers are arranged side-by-side and separated by a barrier wall for storing different materials.

10. The improvement according to claim 1 wherein said compressible storage container is provided by two joined foil sections and said chamber and outlet opening are formed by one of said foil sections and a third foil section totally enclosing said storage container.

11. A method for ejecting small amounts of flowing material from a package by applying external pressure to a compressible container for storing said material, a chamber being provided adjacent to said compressible container which chamber is separated from said container by a predetermined rupture site and communicates with an opening adapted to eject said material characterized by (a) opening said rupture site by applying external pressure on said compressible container and increasing the inner pressure of material within said compressible container, (b) decompressing and retaining said material within said chamber by throttling the flow of said material by means associated with said chamber, and (c) controlling the flow of said material as it is ejected by passing it through said throttling means upon further application of external pressure on said compressible container.

* * * * *